US006595899B2

(12) United States Patent
Liang

(10) Patent No.: US 6,595,899 B2
(45) Date of Patent: Jul. 22, 2003

(54) STEPPING EXERCISER

(76) Inventor: Hung-Min Liang, PO Box 82-144, Taipei (TW)

( * ) Notice: Subject to any disclaimer, the term of this patent is extended or adjusted under 35 U.S.C. 154(b) by 0 days.

(21) Appl. No.: 09/899,248

(22) Filed: Jul. 6, 2001

(65) Prior Publication Data

US 2003/0008750 A1 Jan. 9, 2003

(51) Int. Cl.[7] ..... A63B 22/04
(52) U.S. Cl. ..... 482/53; 482/51
(58) Field of Search ..... 482/51, 52, 53, 482/70, 79, 80

(56) References Cited

U.S. PATENT DOCUMENTS 3,511,500 A * 5/1970 Dunn ..... 482/113
5,298,002 A * 3/1994 Lin ..... 482/53
5,518,470 A * 5/1996 Piaget et al. ..... 482/51
5,807,210 A * 9/1998 Devlin ..... 482/146

* cited by examiner

*Primary Examiner*—Stephen R. Crow
(74) *Attorney, Agent, or Firm*—Leong C. Lei

(57) ABSTRACT

A stepping exerciser includes a base having a transverse rod on which is mounted a U-shaped member, a pair of dampers each having an end pivotally connected with the U-shaped member, a primary rocking arm fixedly connected to an inverted U-shaped seat having a through hole in which is fitted a sleeve, the inverted U-shaped seat being pivotally connected with the U-shaped member by a bolt extending through the U-shaped member, sleeves, and the inverted U-shaped member to engage with a nut, an upper end of the primary rocking arm having a tubular portion, a secondary rocking arm having a rectangular slot close to a lower end which is connected with the inverted U-shaped seat, and a pair of pedals each having a bracket pivotally connected with a respective one of the dampers.

1 Claim, 7 Drawing Sheets

STEPPING EXERCISER

BACKGROUND OF THE INVENTION

1. Field of the Invention

This invention is related to a stepping exerciser and in particular to one which can be adjusted in stroke.

2. Description of the Prior Art

Referring to FIG. 1, the conventional stepping exerciser includes an H-shaped base 11 having a front transverse rod 12 on which is mounted a vertical post 14. The vertical post 14 is provided with a horizontal shaft 13 having two ends each pivotally connected with a pedal 15. The bottom of the pedal 15 is pivotally connected with an end of a hydraulic or pneumatic cylinder 16. The other end of the hydraulic or pneumatic cylinder 16 is pivotally connected with the front transverse rod 12. However, such a conventional stepping exerciser cannot be adjusted thereby causing much inconvenience in use.

Therefore, it is an object of the present invention to provide an improved stepping exerciser which can obviate and mitigate the above-mentioned drawbacks.

SUMMARY OF THE INVENTION

This invention is related to an improvement in the structure of a stepping exerciser.

It is the primary object of the present invention to provide a stepping exerciser wherein the stroke of the pedal can be adjusted.

It is another object of the present invention to provide a stepping exerciser wherein the pedals can be kept at a horizontal position.

According to a preferred embodiment of the present invention, a stepping exerciser includes a base having a transverse rod on which is mounted a U-shaped member, a pair of dampers each having an end pivotally connected with the U-shaped member, a primary rocking arm fixedly connected to an inverted U-shaped seat having a through hole in which is fitted a sleeve, the inverted U-shaped seat being pivotally connected with the U-shaped member by a bolt extending through the U-shaped member, sleeves, and the inverted U-shaped member to engage with a nut, an upper end of the primary rocking arm having a tubular portion, a secondary rocking arm having a rectangular slot close to a lower end which is connected with the inverted U-shaped seat, and a pair of pedals each having a bracket pivotally connected with a respective one of the dampers.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PRESENT INVENTION

Figure 1:
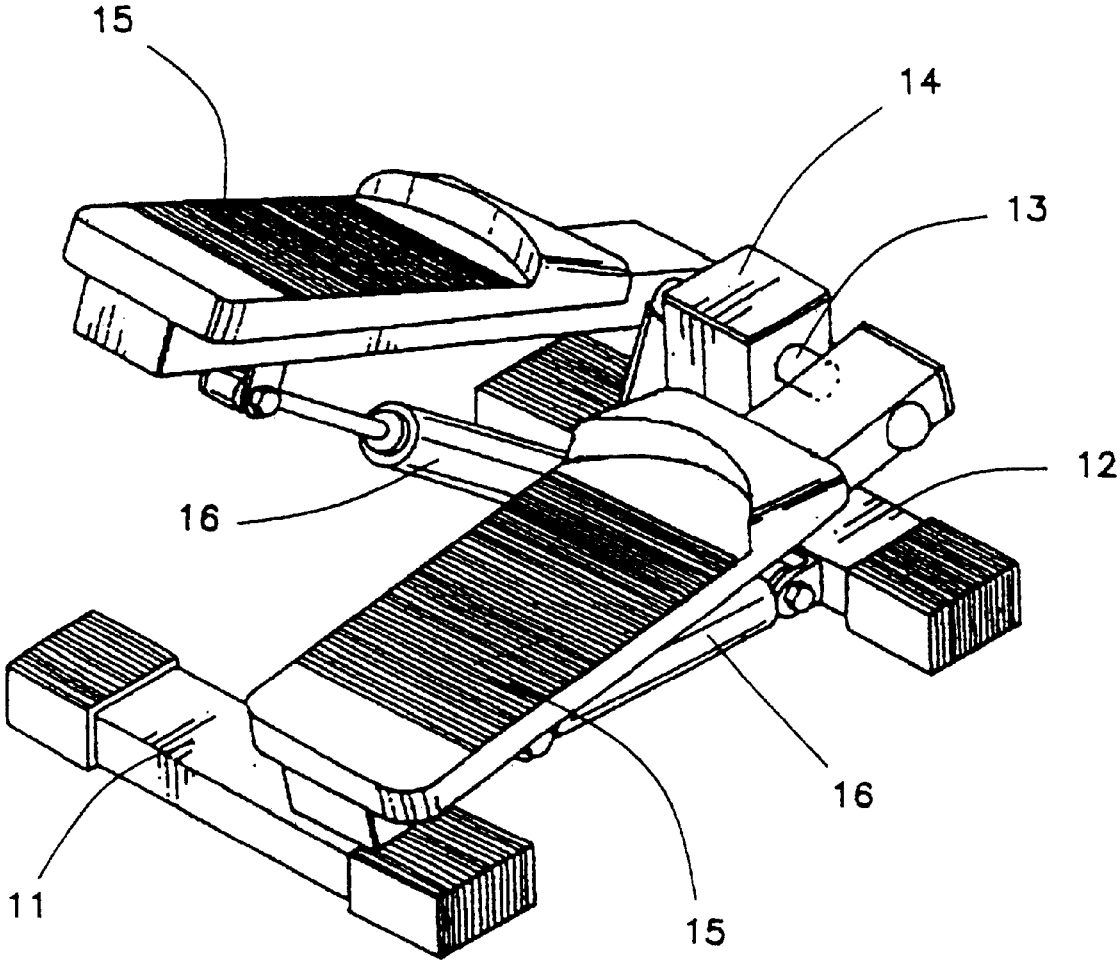
PRIOR ART FIG. 1
FIG. 1 is a perspective view of a prior art stepping exerciser.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Figure 2:
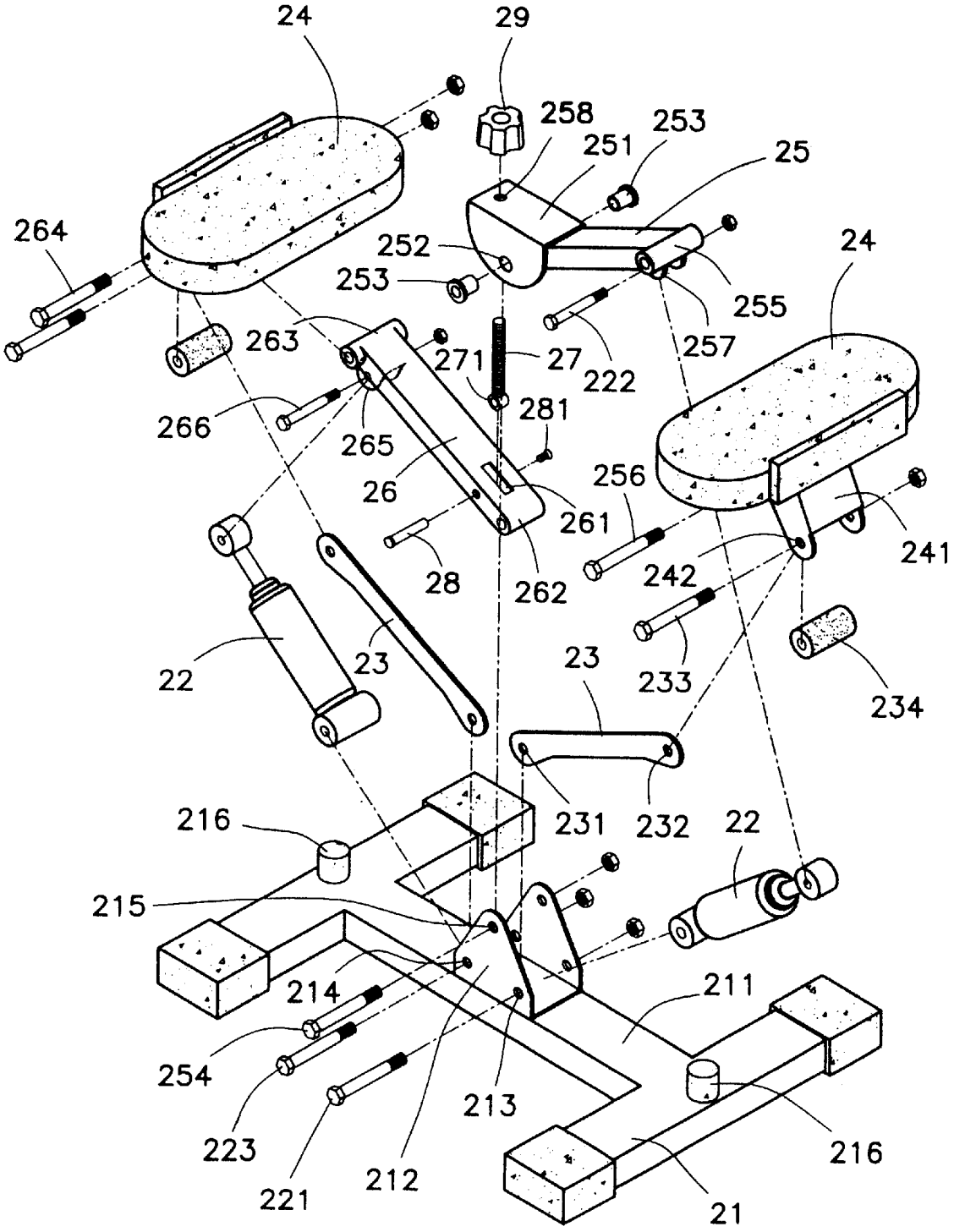
FIG. 2 is an exploded view of a stepping exerciser according to the present invention.
Figure 3:
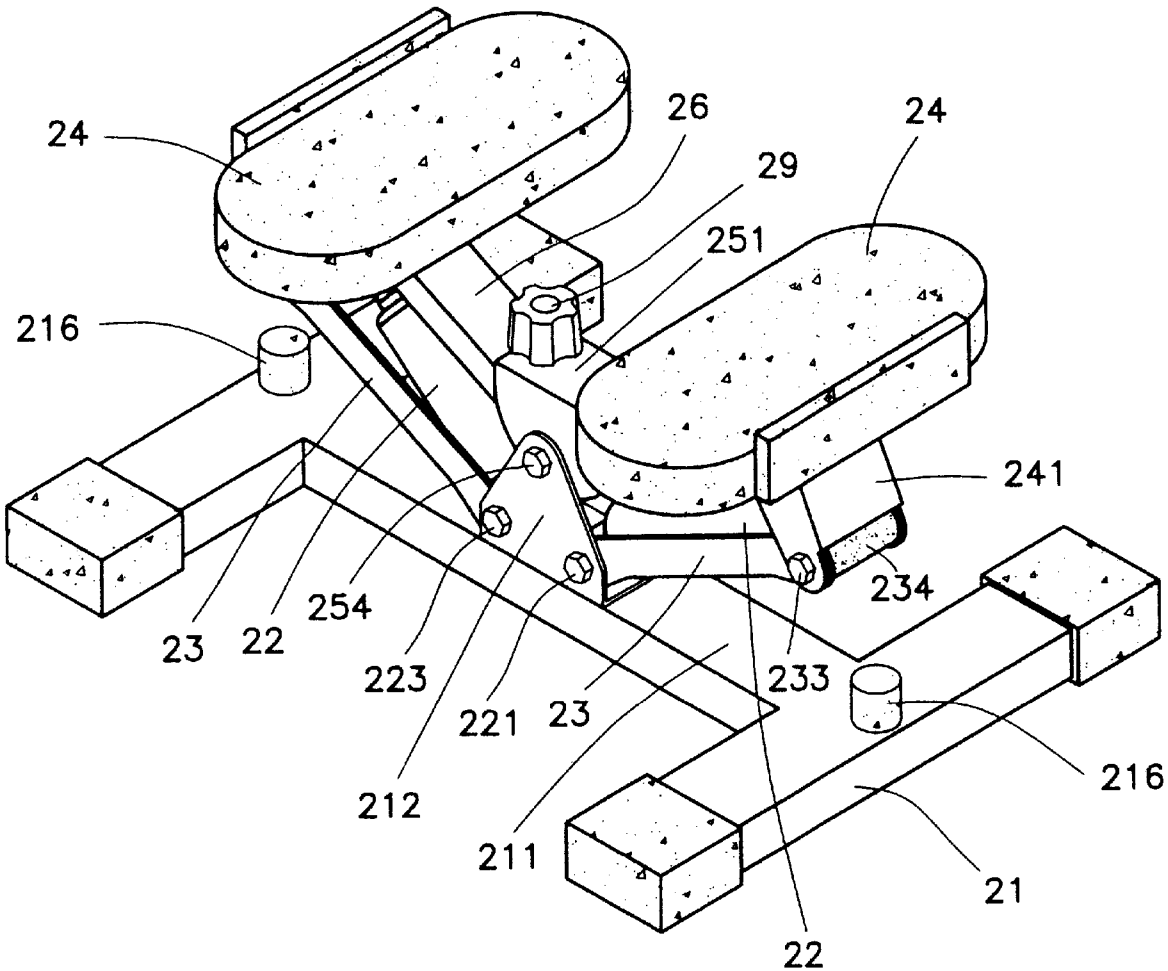
FIG. 3 is a perspective view of the present invention.
Figure 4:
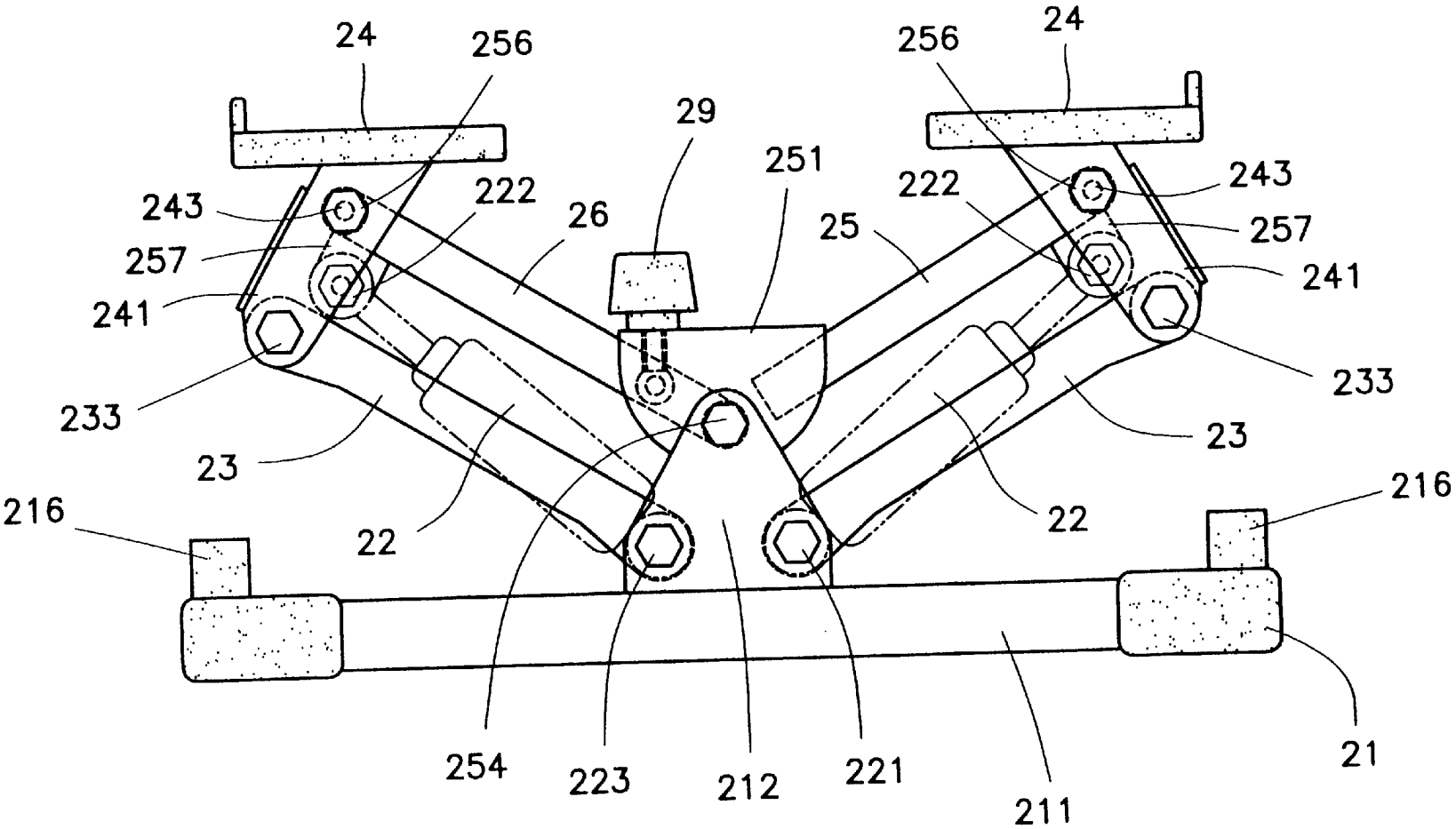
FIG. 4 is a front view of the present invention.

With reference to the drawings and in particular to FIGS. 2, 3 and 4 thereof, the stepping exerciser according to the present invention generally comprises a base 21, a pair of dampers 22, a pair of links 23, a pair of pedals 24, a primary rocking arm 25, a secondary rocking arm 26, and an adjust mechanism.

The base 21 is an H-shaped member having a transverse rod 211 on which is mounted a U-shaped member 212 having three through holes 213, 214 and 215 located in a triangular arrangement. Each end of the transverse rod 211 is provided with a cylindrical projection 216.

The damper 22 may be a hydraulic or pneumatic cylinder. One of the dampers 22 has an end pivotally connected with the hole 213 of the U-shaped member 212, while the other damper 22 has an end pivotally connected with the hole 214 of the U-shaped member 212. The link 23 has two holes 231 and 232 at two ends. An end of the link 23 is pivotally connected to a bracket 241 mounted on the bottom of the pedal 24 by a bolt 233 extending through the hole 232 of the link 23, a sleeve 234, and a through hole 242 of the bracket 241 to engage with a nut. The other end 231 of the link 23 is pivotally connected to the U-shaped member 212 by a bolt 221 extending through the hole 213 of the U-shaped member 212 to engage with a nut. An end of the second link 23 is pivotally connected to a bracket 241 mounted on the bottom of another pedal 24 by a bolt 233 extending through the hole 232 of the second link 23, a sleeve 234, and a through hole 242 of the bracket 241 to engage with a nut. The other end 231 of the second link 23 is pivotally connected to the U-shaped member 212 by a bolt 223 extending through the hole 214 of the U-shaped member 212 to engage with a nut.

The primary rocking arm 25 is fixedly connected to an inverted U-shaped seat 251 having a through hole 252 in which is fitted a sleeve 253. The inverted U-shaped seat 251 is pivotally connected with the U-shaped member 212 by a bolt 254 extending through the hole 215 of the U-shaped member 212, the sleeves 253, and the hole 252 of the inverted U-shaped member 251 to engage with a nut. The upper end of the primary rocking arm 25 has a tubular portion 255 which is pivotally connected with the bracket 241 of the pedal 24 by a bolt 256 extending through the hole 243 of the bracket 241 of the pedal 24 to engage with a nut. The primary rocking arm 25 has two lugs 257 pivotally connected with an upper end of the damper 22 by a bolt 222.

The secondary rocking arm 26 has a rectangular slot 261 close to its lower end 262 which is connected with the inverted U-shaped seat 251 by a bolt 254. The upper end 263 of the secondary rocking arm 26 is pivotally connected with the hole 243 of the bracket 241 of the pedal 24 by a bolt 264. The secondary rocking arm 26 has two lugs 265 on the bottom side of the upper end 263 which is pivotally connected with an upper end of the damper 22.

It should be noted that the lower end 262 of the secondary rocking arm 26 is first fitted within the inverted U-shaped seat 251 and then pivotally connected with the hole 215 of the U-shaped member 212 by the bolt 254.

The adjust mechanism includes a bolt 27, a pin 28 and a knob 29. The lower end of the bolt 27 is formed with a ring portion 271 which is inserted into the rectangular slot 261 of the secondary rocking arm 26. The pin 28 extends through the secondary rocking arm 26 and the ring portion 271 of the bolt 27 to engage with a nut 281. The upper end of the bolt 27 extends upwardly through a hole 258 of the inverted U-shaped seat 251 to engage with the knob 29 by means of which the stroke of the pedals 24 can be adjusted.

Figure 5:
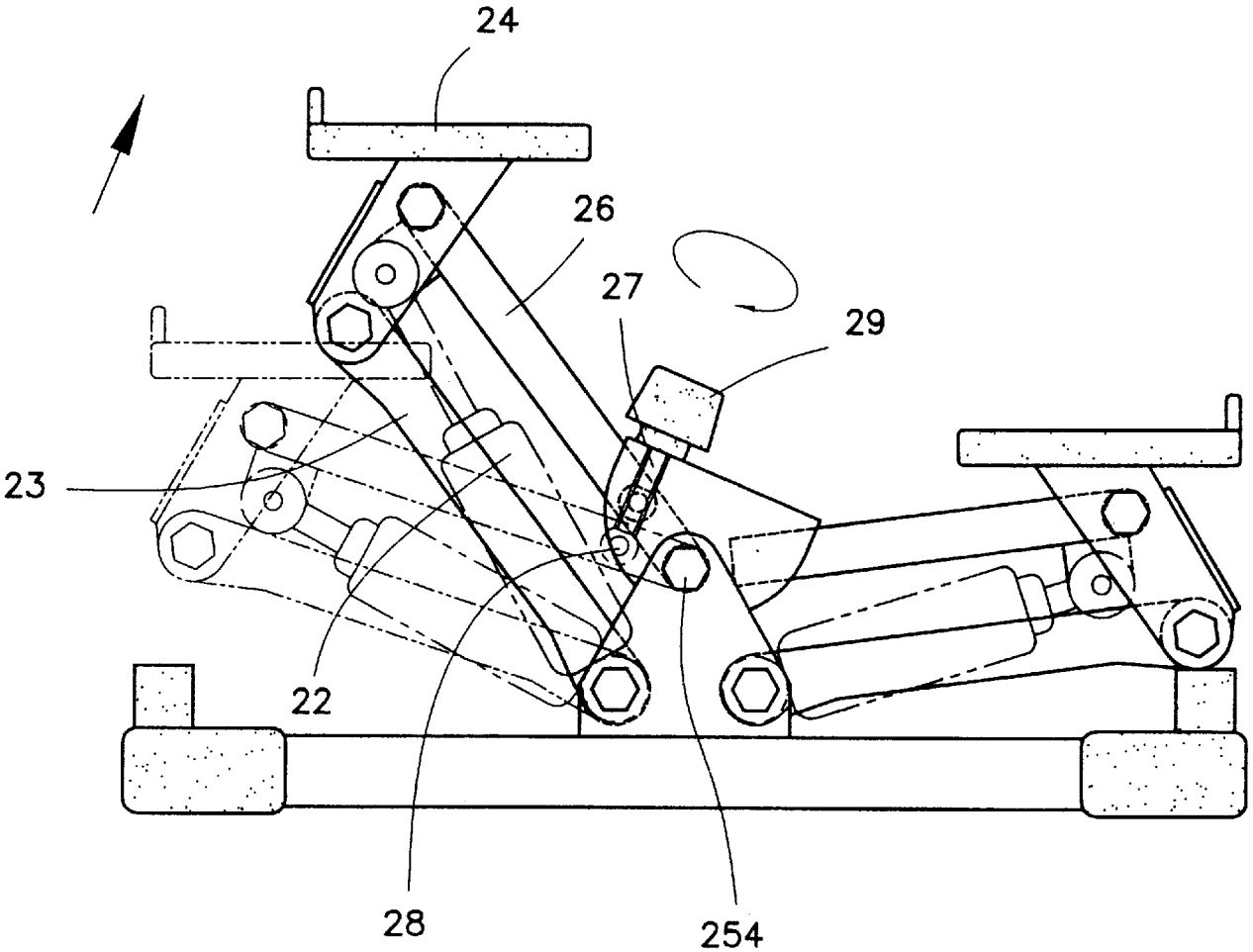
FIGS. 5 and 6 illustrate how to adjust the present invention.
Figure 6:
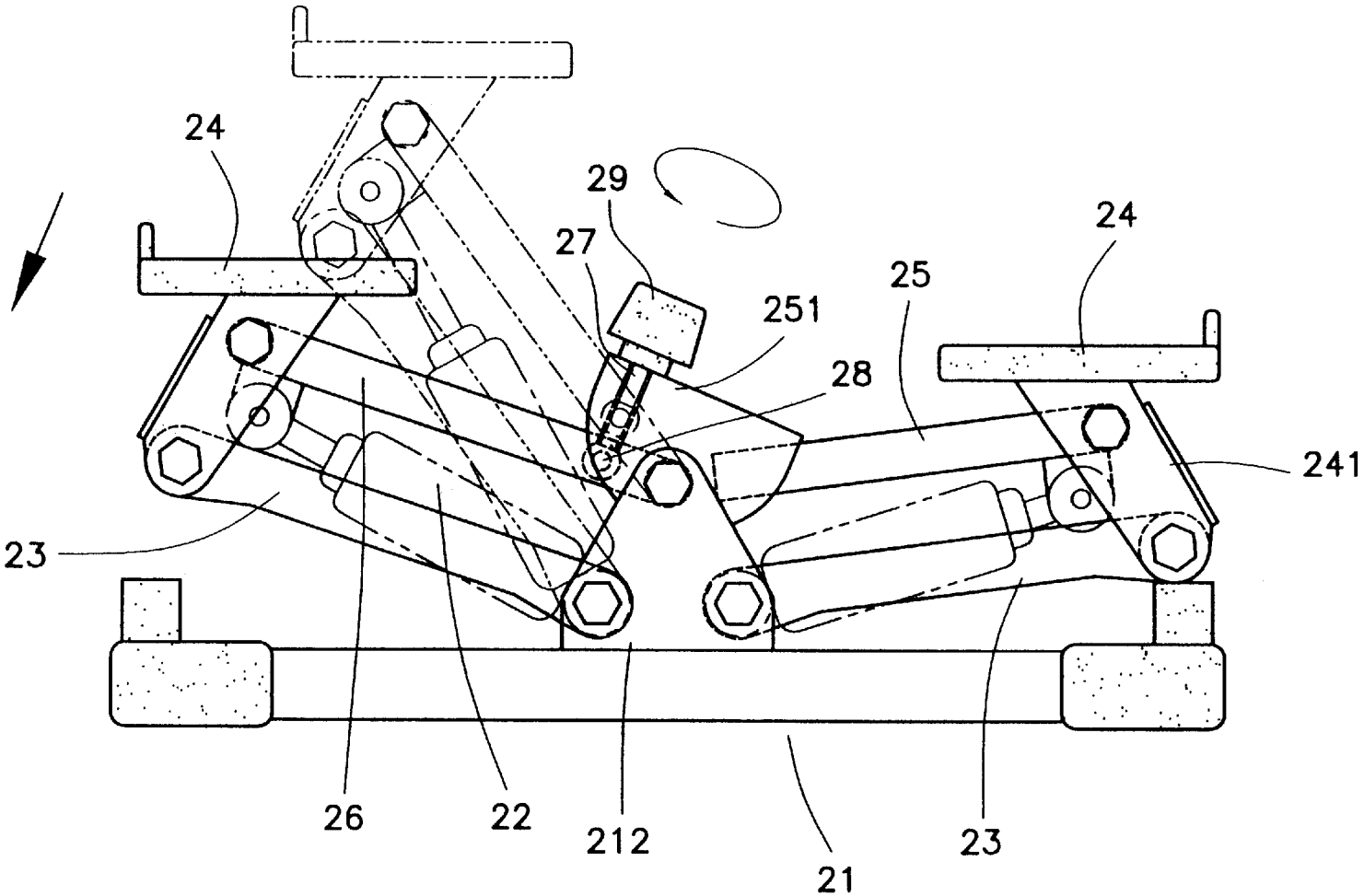

When desired to adjust the stroke of the pedal 24 (see FIG. 5), it is only necessary to tighten the knob 29 by turning so that the secondary rocking arm 26 is moved upwardly about the bolt 254 via the inverted U-shaped seat 251 and the pin 28. In the meantime, the secondary rocking arm 26 moves the pedal 24, the damper 22 and the link 23 to go upwardly thereby increasing the stroke of the pedal 24. As shown in FIG. 6, when the knob 29 is loosened, the secondary rocking arm 26 is moved downwardly via the bolt 27 and the pin 28. Meanwhile, the secondary rocking arm 26 moves the pedal 24, the damper 22 and the link 23 to go downwardly thereby decreasing the stroke of the pedal 24.

Figure 7:
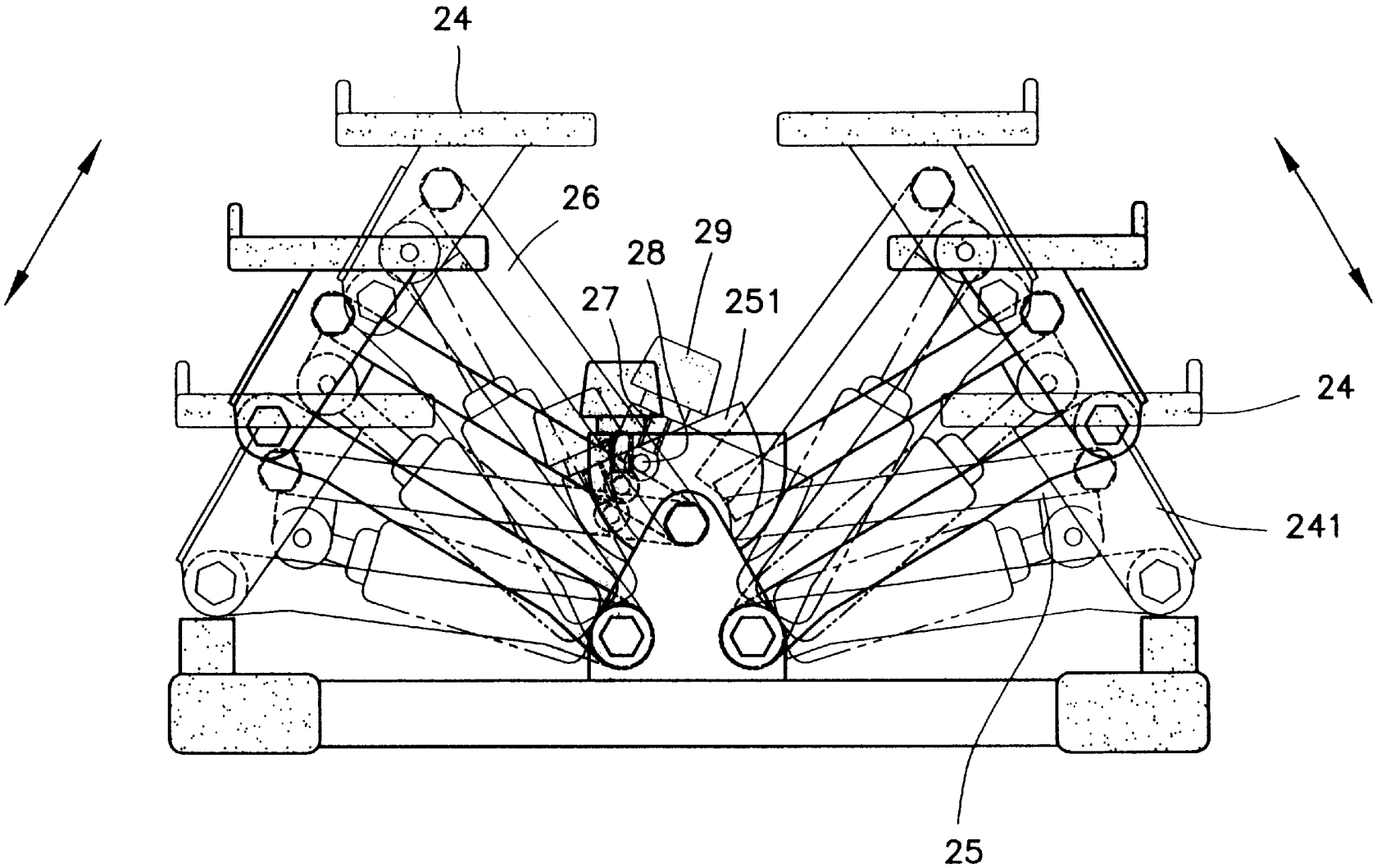
FIG. 7 is a working view of the present invention.

Referring to FIGS. 6 and 7, when the pedal 24 is stepped on, the primary rocking arm 25 will be moved with respect to the bracket 241 thereby moving the inverted U-shaped seat 251, the knob 29, the bolt 27 and the pin 28 and therefore moving the secondary rocking arm 26 and the pedal 24 upwardly.

However, it should be noted that the link 23 pivotally connected with the U-shaped member 212 of the base 21 and the bracket 241 of the pedal 24 will move in unison with the bracket 241 when the pedal 24 is moved up and down thereby keeping the pedal 24 in a horizontal positional.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A stepping exerciser comprising:

a base having a transverse rod on which is mounted a U-shaped member;

a pair of dampers each having an end pivotally connected with said U-shaped member;

a primary rocking arm fixedly connected to an inverted U-shaped seat having a through hole in which is fitted a sleeve, said inverted U-shaped seat being pivotally connected with said U-shaped member by a bolt extending through said U-shaped member, an upper end of said primary rocking arm having a tubular portion which is pivotally connected with an upper end of one said dampers;

a secondary rocking arm having a lower end which is connected with said inverted U-shaped seat, said secondary rocking arm having an upper end provided with two lugs pivotally connected with an upper end of a respective one of said dampers;

a pair of pedals each having a bracket pivotally connected with a respective one of said dampers; and a pair of links pivotally connected with said U-shaped member of said base and said bracket of a respective said pedal, said links moving in unison with said bracket when said pedal is moved up and down thereby keeping said pedal in a horizontal position.

* * * * *